US005129596A

United States Patent [19]

Wagener

[11] Patent Number: 5,129,596

[45] Date of Patent: Jul. 14, 1992

[54] LANDING GEAR OF A MODEL AIRPLANE

[75] Inventor: Claus Wagener, Dietenhofen, Fed. Rep. of Germany

[73] Assignee: Fritz Wagener GmbH, Dietenhofen, Fed. Rep. of Germany

[21] Appl. No.: 793,281

[22] Filed: Nov. 12, 1991

Related U.S. Application Data

[63] Continuation of Ser. No. 585,390, Sep. 20, 1990, abandoned.

[30] Foreign Application Priority Data

Oct. 19, 1989 [DE] Fed. Rep. of Germany ..... 3934839

[51] Int. Cl.[5] ..... B64C 25/48

[52] U.S. Cl. ..... 244/104 R; 244/104 CS

[58] Field of Search ..... 244/104 R, 104 CS, 100; 446/34

[56] References Cited

U.S. PATENT DOCUMENTS

| | | | |
|---|---|---|---|
| 1,812,143 | 6/1931 | Dugan | 244/104 CS |
| 2,118,455 | 5/1938 | Wallace | 244/104 FP |
| 3,289,877 | 12/1966 | Wolf | 16/225 |
| 4,172,570 | 10/1979 | Leoni | 244/104 CS |
| 4,236,274 | 12/1980 | Omote et al. | 16/225 |
| 4,337,912 | 7/1982 | Watton | 244/102 R |
| 4,359,199 | 11/1982 | Krowner et al. | 244/104 R |
| 4,892,270 | 1/1990 | Derrien et al. | 244/104 R |

FOREIGN PATENT DOCUMENTS 0306412 1/1930 United Kingdom ..... 244/104 CS

*Primary Examiner*—Joseph F. Peters, Jr.
*Assistant Examiner*—Virna Lissi Mojica
*Attorney, Agent, or Firm*—Akoo-Toren

[57] ABSTRACT

The invention relates to a landing gear, wherein a connecting plate 12 is joined to a strut tube 5 of a shock strut which is joined to a bearing member 1, and wherein the strut tube 5 houses an inner member 8 which with its terminal end engages the bearing member 1. It is desirable to model a shock strut formed with a deflecting C-member and hydraulic spring system with simple means as authentically as possible. This is achieved in that the strut tube 5 is joined to the bearing member 1 via a spring-action C-member 7 to permit up and down motions while the connecting plate 12 is solidly attached, in that the bearing member 1 is of integral construction with the connecting plate 12, the strut tube 5 and the C-member and in that the inner member is formed as a metal pin 8 which is axially slidable in the strut-tube 5, the metal pin 8 being loaded at its one end by a metal compression coil spring 10 abutting on a fixed part at its far end. Integral construction and the use of the two simple and low-cost metal parts, viz the pin and coil spring, afford simplified production of plastic parts and simplified assembly.

5 Claims, 1 Drawing Sheet

LANDING GEAR OF A MODEL AIRPLANE

Figure 2:
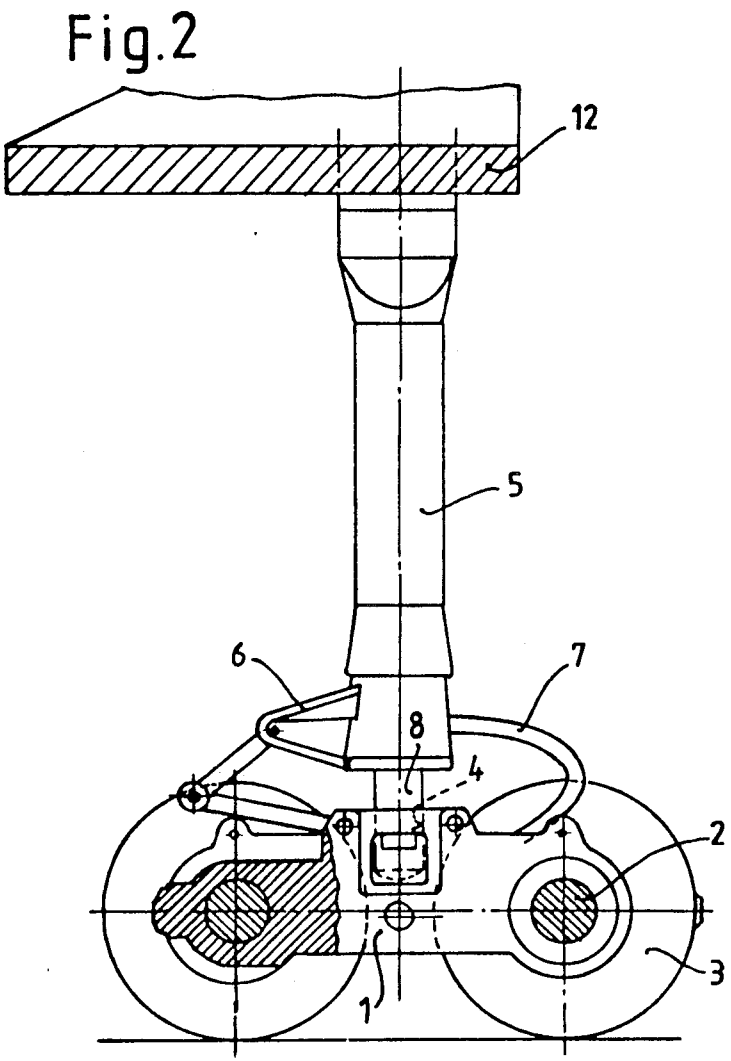

This is a continuation application of Ser. No. 07/585,390, filed Sept. 20, 1990 now abandoned.

This invention relates to a landing gear of a model airplane which substantially consists of plastic, wherein a connecting plate is joined to the top end of the strut tube of a shock strut, the strut tube being capable of moving up and down and the shock strut being joined at its bottom end to a bearing member on which is provided a twin-wheel unit, wherein the strut tube houses an inner member which with its bottom end portion extending from the strut tube engages the bearing member, wherein the shock strut is associated with a spring system, and wherein the connection plate, the strut tube and a spring member are of integral construction.

In a prior-art (German Utility Patent 87 14 737) landing gear of this type, the strut tube is joined to the connection plate by means of two spring arms in a manner permitting up and down motions and separate from the bearing member. The inner member is formed by two folded arms and located axially immovably in the strut tube. Spring action is obtained by deflection of the spring arms, whereby the shock strut moves up and down with the bearing member. There is a landing gear consisting substantially of metal of a real full-size aircraft where a strut tube is joined to a bearing member via a C-member permitting up and down motions and solidly attached to a connecting piece. The shock strut forms a hydraulic spring system comprising a piston and cylinder which engages the bearing member with a piston rod extending from the bottom end of the cylinder.

It an object of the present invention to provide a landing gear of a model airplane of the type initially referred to, wherein the shock strut design with a C-member and hydraulic spring system is modelled as authentically as possible with simple means. In achieving this object, the landing gear according to the invention is characterized in that the strut tube is joined to the bearing member via a spring-action C-member permitting up and down motions whereas it is solidly attached to the connecting plate, in that the bearing member with the connecting plate, the strut tube and C-member are of integral construction, and in that the inner member is a metal pin arranged to slide axially in the strut tube, said metal pin being loaded at its one end by a metal compression coil spring abutting on a seat at its far end.

The authentic modelling of the landing gear can be achieved with extremely simple means. The adoption of integral construction and the use of the two simple and low-cost metal parts, viz pin and coil spring, afford simplified production of plastic parts and simplified assembly. Since the spring system is also formed by the deflecting C-member consisting of plastic, it is possible to use a very simple metal compression coil spring. The metal pin engaging the bearing member stabilizes the connection between the shock strut and the bearing member and prevents lateral bending of the deflecting C-member.

It is specially desirable and advantageous if the bearing member is of block shape and fitted with two twin-wheel units. This affords a simple method of joining the metal pin to the bearing member and/or having it engage the latter in a manner that improved stabilization is obtained of the joint between the shock strut and the bearing member and lateral bending is prevented.

It is furthermore specially desirable and advantageous, if the metal pin is formed with a widened head at its end facing the compression coil spring and if the coil diameter matches the pin head diameter. The metal pin may substantially be of a very thin thickness and it is also possible to use a compression coil spring whose coil diameter is of sufficient size to match the head diameter.

Moreover, it is specially desirable and advantageous if the compression coil spring is arranged at the top end of the metal pin and abutting on a seat at the top. In this case, it is specially desirable and advantageous, if the top abutment of the compression coil spring with the strut tube open at the top is formed by a portion of the fuselage of the model airplane. This will simplify assembly because there is no need for a separate abutment part to be installed subsequently. The metal pin and the compression coil spring may, for instance, be installed through the bearing member which would then have to be subsequently closed again. It is simpler to insert the metal parts from the top.

Finally, it is specially desirable and advantageous if the connecting plate is formed as a flat flange at the underside of which is located the top end of the strut tube. This flange arranged to fit in a suitable recess on the fuselage of the model airplane will hold the shock strut with sufficient stability and secure the landing gear to the fuselage.

Figure 1:
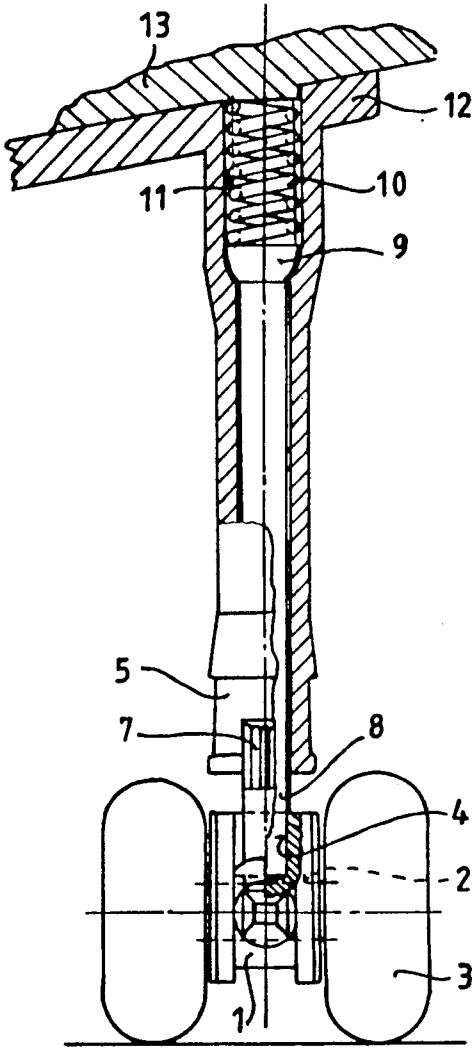

A preferred embodiment of the invention is illustrated in the accompanying drawing in which FIG. 1 is a front view with a sectioned portion of the landing gear of a model airplane, and FIG. 2 is a side elevation of the landing gear in FIG. 1.

The landing gear shown in the drawing has a block-shaped bearing member 1 through which penetrate two parallel shafts 2 which on both sides of the bearing member 1 carry a wheel 3 each. Between the two shafts 2 in the bearing member 1 there is formed a cup-shaped socket 4 whose depth is more than one third of the depth of the bearing member. Inserted into the socket 4 is the lower end of a vertical metal pin 8 of round cross-section with the greater part of its length housed in a strut tube 5. Extending from the lower end of the strut tube 5, there are two deflecting C-members 6, 7 which terminate in the bearing member 1. The two C-members 6, 7 are arranged for and aft of the strut tube 5, each extending between the two wheels 3 arranged on a shaft 2. The one C-member 6 is angular and the other C-member 7 is round. The bore in the strut tube 5 is increased in its upper end portion to accommodate a widened head of the metal pin 8 and a compression coil spring 10 and continues into a cutout 11 in a connecting plate 12 which is formed as a flat flange. The cutout 11 is covered by part of the fuselage 13 to which the connecting plate 12 is applied from below.

I claim:

1. Landing gear for a model airplane, consisting substantially of plastic, comprising:

a shock strut having a vertically movable strut tube;

a connecting plate joined to a top end of the strut tube;

a bearing member;

at least one twin-wheel unit connected to the bearing member;

a metal pin housed within the strut tube so as to be axially slidable therein and so that a bottom end portion of the metal pin extends from the strut tube and engages the bearing member; and a spring system associated with the shock strut and including a C-shaped spring member which is joined to the strut tube so as to permit vertical movement, the bearing member, the connecting plate, the strut tube and the C-shaped member being integrally formed as a single plastic piece, the spring system further including a metal compression coil spring which abuts an upper end of the metal pin, said compression coil spring having a bottom end arranged at the upper end of the metal pin, and a top end which abuts on a fixed part of the model airplane together with the connecting plate, the strut tube having an open top end at which the fixed part is formed by a part of the model airplane.

2. Landing gear as defined in claim 1, wherein said bearing member has a block shape and is provided with two twin-wheel units.

3. Landing gear as defined in claim 1, wherein said bearing member has a top portion formed with a socket opening into which the lower end of the metal pin extends.

4. Landing gear as defined in claim 1, wherein said metal pin has a widened head which faces the compression coil spring, the widened head and coil spring having equal diameters.

5. Landing gear as defined in claim 1, wherein the connecting plate is formed as a flat flange having an underside at which a top end of the strut tube is located.

* * * * *